US008674884B2

(12) United States Patent
Lin et al.

(10) Patent No.: US 8,674,884 B2
(45) Date of Patent: Mar. 18, 2014

(54) DUAL-BAND CIRCULARLY POLARIZED ANTENNA

(75) Inventors: Chia-Hong Lin, Hsinchu (TW); I-Shan Chen, Hsinchu (TW); Chang-Hsiu Huang, Hsinchu (TW); Chin-Yu Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 197 days.

(21) Appl. No.: 13/271,237

(22) Filed: Oct. 12, 2011

(65) Prior Publication Data

US 2013/0027253 A1 Jan. 31, 2013

(30) Foreign Application Priority Data

Jul. 28, 2011 (TW) ..... 100126770 A

(51) Int. Cl.
*H01Q 1/38* (2006.01)

(52) U.S. Cl.
USPC ..... 343/700 MS; 343/713; 340/10.4

(58) Field of Classification Search
USPC ..... 343/700 MS
See application file for complete search history.

(56) References Cited

U.S. PATENT DOCUMENTS

| | | | | |
|---|---|---|---|---|
| 6,642,819 | B1 * | 11/2003 | Jain et al. | 333/246 |
| 7,253,770 | B2 * | 8/2007 | Yegin et al. | 343/700 MS |
| 2009/0219144 | A1 * | 9/2009 | Pettus | 340/10.4 |

* cited by examiner

*Primary Examiner* — Jerome Jackson, Jr.
*Assistant Examiner* — Hai Tran
(74) *Attorney, Agent, or Firm* — Winston Hsu; Scott Margo

(57) ABSTRACT

A dual-band circularly polarized antenna is disclosed, which includes a ground metal plate, a dielectric substrate, a first microstrip radiation portion and a second microstrip radiation portion. The dielectric substrate is formed on the ground metal plate. The first microstrip radiation portion is formed on the dielectric substrate and has at least one pair of symmetric truncated corners. The second microstrip radiation portion is formed on the dielectric substrate and includes a plurality of radiation units. Each of the plurality of radiation units is extended from the first microstrip radiation portion along a first direction.

11 Claims, 11 Drawing Sheets

DUAL-BAND CIRCULARLY POLARIZED ANTENNA

BACKGROUND OF THE INVENTION

1. Field of the Invention

The present invention relates to an antenna, and more particularly, to a dual-band circularly polarized antenna capable of implementing single-plane, dual-band circular polarization on a single dielectric substrate.

2. Description of the Prior Art

With advancement of wireless communication, various wireless applications have become one of the most important means of exchanging data (e.g. voice, text, video, etc.) in society. At the same time, in accordance with portability and functional requirements, light-weight, small form factor, and compactness have become the design criteria. Also, integration of multi-functionalities into a same mobile device has also become an inevitable trend. Therefore, a compact and multi-frequency band antenna has become a common goal for the industry.

For example, a common car satellite communication device usually integrates Global Positioning System (GPS) and Satellite Digital Audio Radio Service (SDARS) functionalities. Since GPS and SDARS have different operation frequency bands, and a GPS signal is a right-handed circularly polarized electromagnetic (EM) wave, a receiving antenna must have a right-handed circularly polarized radiation field pattern to receive the GPS signal. Similarly, a SDARS signal is a left-handed circularly polarized EM wave, and thus a receiving antenna must also have a left-handed circularly polarized radiation field pattern to receive the SDARS signal. In such a case, two separate antennas are usually needed for each signal. Please refer to FIG. 1, which is a schematic diagram of a microstrip antenna (Patch antenna) 10 of a conventional car satellite communication device. The microstrip antenna 10 includes an antenna A_GPS, an antenna A_SDARS, and a signal feed-in portion 106. The antenna A_GPS transmits and receives GPS signals, and the antenna A_SDARS transmits and receives SDARS signals. To obtain dual-band circular polarization, the microstrip antenna 10 is usually implemented via a multi-layer, stacked architecture. As shown in FIG. 1, the antenna A_GPS (formed by a dielectric substrate 102 and a microstrip radiation portion 108) and the antenna A_SDARS (formed by a dielectric substrate 104 and a microstrip radiation portion 110) are stacked together. However, despite small dimensions of the microstrip radiation portion, a dielectric substrate comparatively occupies considerable space, and is costly to manufacture. Therefore, reducing dimensions for a multi-band antenna while lowering costs has become an important issue for antenna design.

SUMMARY OF THE INVENTION

Therefore, the present invention primarily provides a dual-band circularly polarized antenna. A dual-band circularly polarized antenna is disclosed. The dual-band circularly polarized antenna comprises a ground metal plate; a dielectric substrate, formed on the ground metal plate; a first microstrip radiation portion, formed on the dielectric substrate, and having at least one pair of symmetric truncated corners; and a second microstrip radiation portion, formed on the dielectric substrate, comprising a plurality of radiation units, wherein each of the radiation units is extended from the first microstrip radiation portion along a first direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
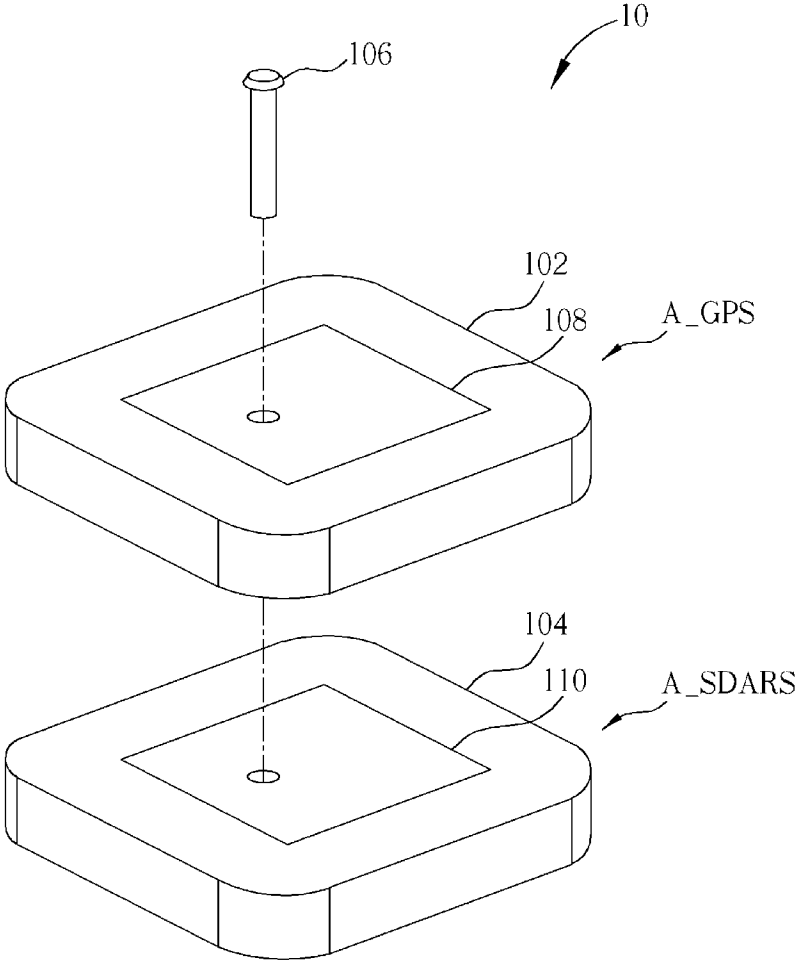
FIG. 1 PRIOR ART
FIG. 1 is a schematic diagram of a microstrip antenna of a conventional car satellite communication device.
Figure 2:
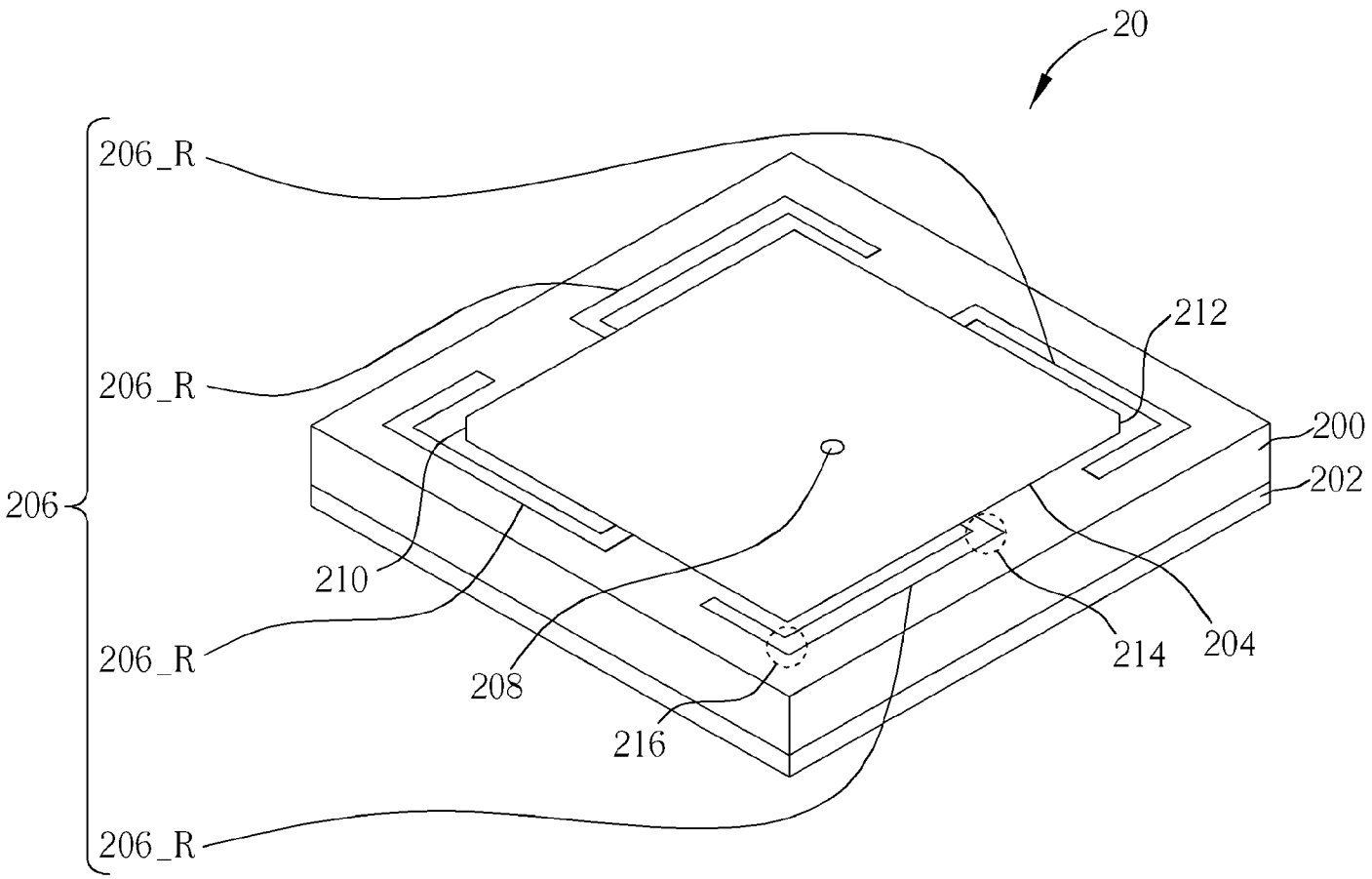
FIG. 2 is a three-dimensional schematic diagram of a dual-band circularly polarized antenna according to an embodiment of the invention.
Figure 3:
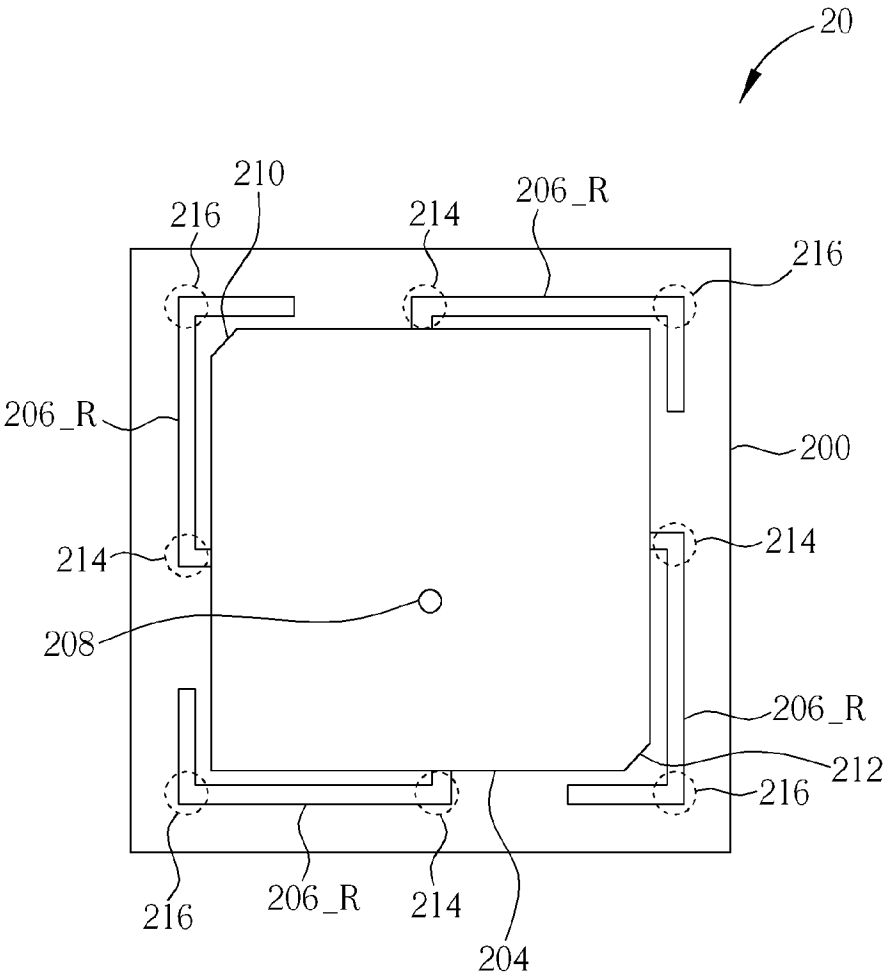
FIGS. 3 and 4 are schematic diagrams of a top-view and a side-view of the dual-band circularly polarized antenna shown in FIG. 2, respectively.
Figure 4:
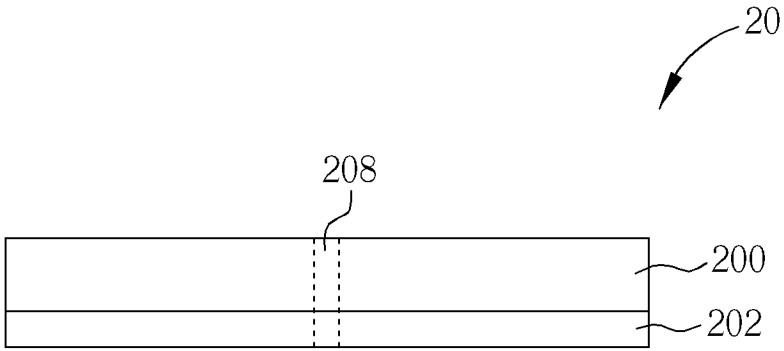

Please refer to FIGS. 2 to 4; FIG. 2 is a three-dimensional schematic diagram of a dual-band circularly polarized antenna 20 according to an embodiment of the invention. FIGS. 3 and 4 are schematic diagrams of a top-view and a side-view of the dual-band circularly polarized antenna 20 shown in FIG. 2, respectively. The dual-band circularly polarized antenna 20 includes a dielectric substrate 200, a ground metal plate 202, a first microstrip radiation portion 204, a second microstrip radiation portion 206, and a signal feed-in portion 208. The ground metal plate 202 is used for providing grounding. The dielectric substrate 200 is formed on the ground metal plate 202. The first microstrip radiation portion 204 and second microstrip radiation portion 206 are formed on the dielectric substrate 200, and used for signal transmission and reception. Simply, the first microstrip radiation portion 204 operates in a first frequency band and has a first radiation field pattern; the second microstrip radiation portion 206 operates in a second frequency band, and has a second radiation field pattern. As such, the dual-band circularly polarized antenna 20 can implement an antenna having dual frequency bands. For example, in a car satellite communication device, the first microstrip radiation portion 204 may operate in a Satellite Digital Audio Radio Service (SDARS) frequency band, whereas the second microstrip radiation portion 206 may operate in a Global Positioning System (GPS) frequency band, but this is not limited thereto.

In more detail, the first microstrip radiation portion 204 has a pair of symmetric truncated corners 210 and 212. The truncated corners 210 and 212 may be disposed at two diagonal opposite ends on the first microstrip radiation portion 204, respectively, for enhancing the circular polarization of the first microstrip radiation portion 204. The truncated corners are positioned according to polarization characteristics of the first microstrip radiation portion 204. For example, as shown in FIG. 2, the truncated corners 210 and 212 are disposed at a top-left corner and a bottom-right corner of the first microstrip radiation portion 204, respectively. In this case, the first microstrip radiation portion 204 may be used for a left-handed circularly polarized signal. Furthermore, positioning of the truncated corners of the first microstrip radiation portion 204 depends on an overall system requirement. For instance, if the truncated corners 210 and 212 are respectively disposed on a bottom-left and top-right corner of the first microstrip radiation portion 204, then the first microstrip radiation portion 204 may be used for a right-handed circularly polarized signal.

The second microstrip radiation portion 206 includes a plurality of radiation units 206_R, wherein each of the radiation units 206_R extends from the first microstrip radiation portion 204 along a specific direction, e.g. clockwise, anticlockwise, a direction away from the first microstrip radiation portion 204, or any other direction. As such, each of the radiation units 206_R would at least partially enclose the first microstrip radiation portion 204. Preferably, all of the radiation units 206_R are symmetrically distributed around the first microstrip radiation portion 204. On the other hand, each of the radiation units 206_R would include at least a bent segment, wherein each bent segment is bent towards the same specific direction, such that each radiation unit extends in the specific direction. As shown in FIG. 2, the second microstrip radiation portion 206 includes four radiation units 206_R. Each of the radiation units 206_R is coupled to the first microstrip radiation portion 204 and extends along a clockwise direction. Each radiation unit 206_R includes two bent segments, bent segment 214 and bent segment 216. The bent segments 214 and 216 are both bent in the clockwise direction, such that the radiation units 206_R extend in the clockwise direction. Moreover, an extending direction of each of the radiation units 206_R corresponds to a polarization direction of the second microstrip radiation portion 206. For example, as shown in FIG. 2, all of the radiation units 206_R are extended along the clockwise direction, and thus the second microstrip radiation portion 206 may be used for a right-handed circularly polarized signal. Moreover, since each of the radiation units 206_R is extended from the first microstrip radiation portion 204, the radiation unit 206_R may be coupled perpendicularly (or at any angle) to the first microstrip radiation portion 204 at a junction with the microstrip radiation portion 204. Positioning of the signal feed-in portion 208 is related to a communication system in which the first microstrip radiation portion 204 is used, and is well-known to those skilled in the art and thus not further described here.

Compared to a conventional multi-layered, stacked multi-band microstrip antenna, the dual-band circularly polarized antenna of the invention implements a single-plane, dual-band circularly polarized architecture on a single dielectric substrate to provide an antenna with dual frequency band functionality. As such, the dual-band circularly polarized antenna of the invention not only effectively reduces dimensions of the antenna, but also greatly lowers an overall weight and production cost through reducing the required thickness and area of the dielectric substrate.

Figure 5:
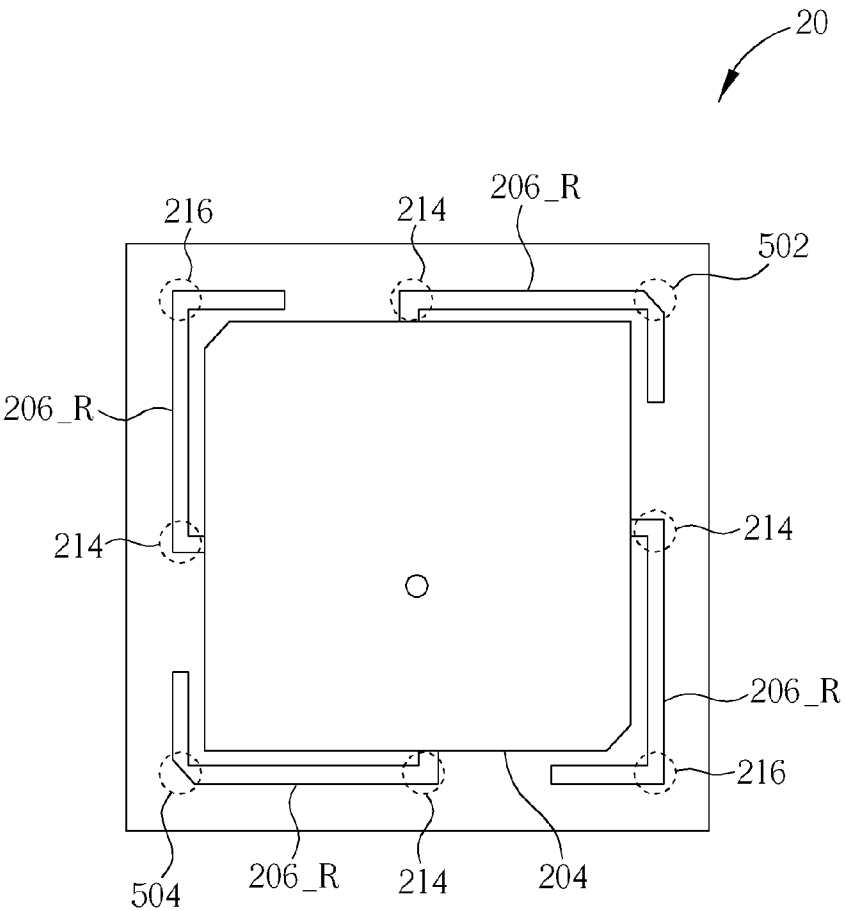
FIGS. 5 to 8 are schematic diagrams of variations of the dual-band circularly polarized antenna shown in FIG. 2 according to different embodiments.

According to the invention, each of the radiation units 206_R can be extended in a generally same direction to enhance the circular polarization characteristics of the second microstrip radiation portion 206. Moreover, circular polarization characteristics of the second microstrip radiation portion 206 may also be enhanced via adding truncated corners. For example, it is possible to dispose a pair of truncated corners at symmetric positions on each of two radiation units 206_R, respectively. Please refer to FIG. 5, which is a schematic diagram of the second microstrip radiation portion 206 having truncated corners. Truncated corners 502 and 504 are disposed at the bent segments of two radiation units 206_R in the second microstrip radiation portion 206, respectively.

Figure 6:
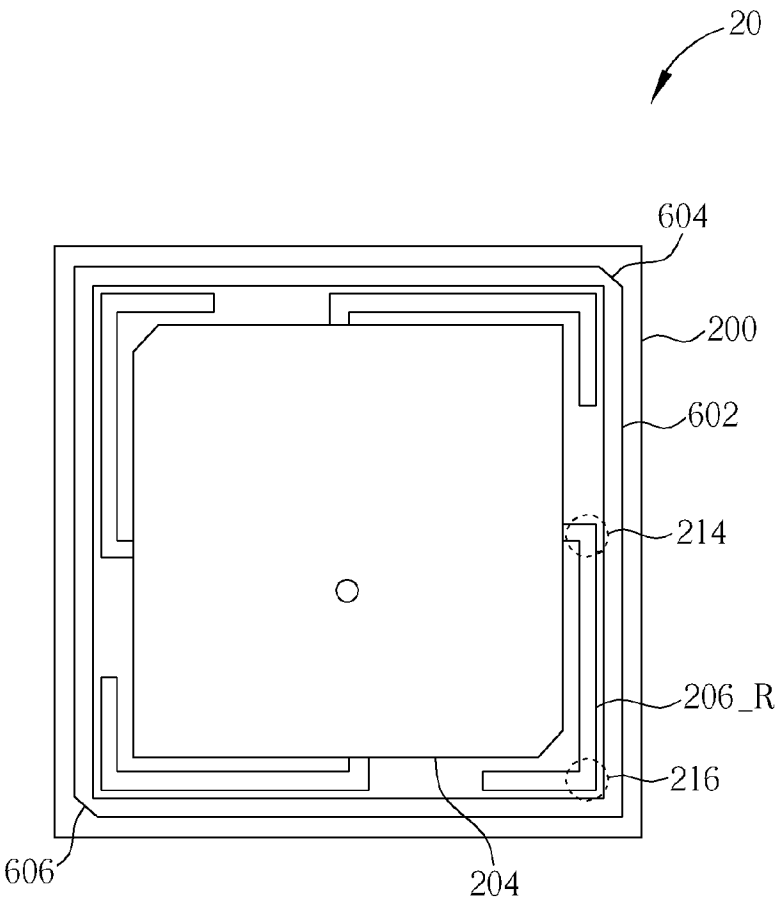

Furthermore, please refer to FIG. 6, which is a schematic diagram of the second microstrip radiation portion 206 having an annular radiation unit. The second microstrip radiation portion 206 further includes an annular radiation unit 602, formed on the dielectric substrate 200, and encloses all of the radiation units 206_R. Through the addition of the annular radiation unit, a current path of the second microstrip radiation portion 206 may be further enhanced, thus improving performance of the second microstrip radiation portion 206. On the other hand, as shown in FIG. 6, the annular radiation unit 602 may also include truncated corners 604 and 606 to enhance circular polarization characteristics of the second microstrip radiation portion 206.

Figure 7:
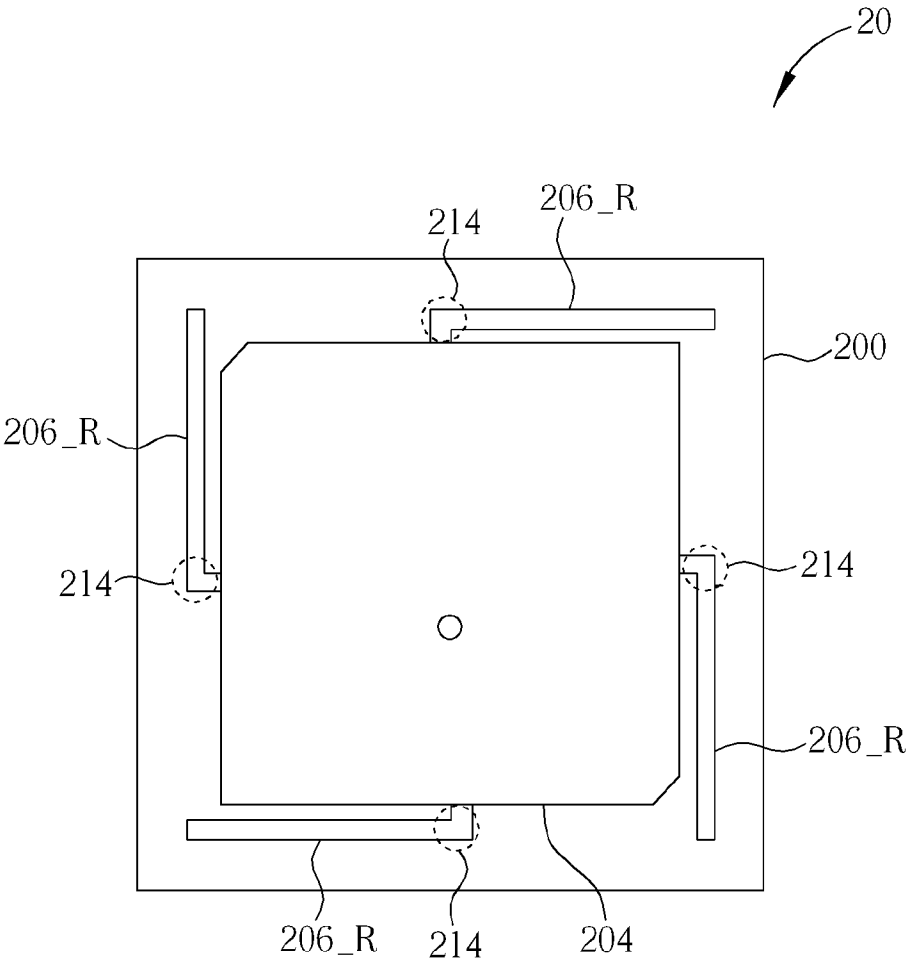
Figure 8:
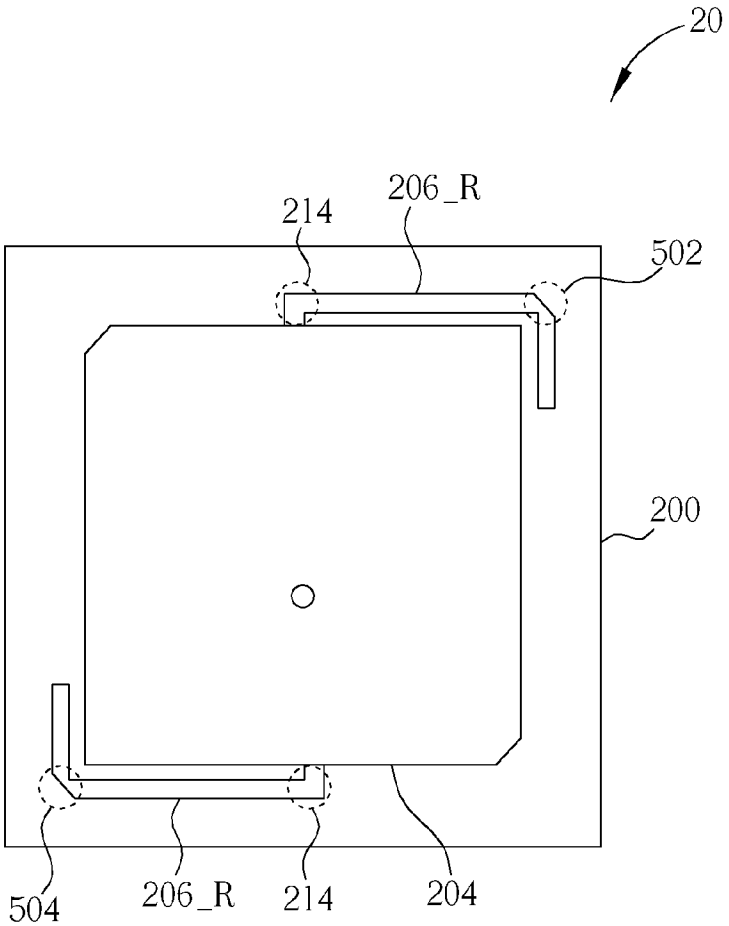

Note that, the dual-band circularly polarized antenna 20 is merely an embodiment of the invention, and suitable modifications may be made accordingly by those skilled in the art. For example, an operation frequency of the first microstrip radiation portion 204 may be modified by adjusting its area; likewise, an operation frequency of the second microstrip radiation portion 206 may be modified by adjusting segment length and width of each of the radiation units 206_R. A shape of the first microstrip radiation portion 204 is not limited; for example, the first microstrip radiation portion 204 in FIG. 2 is a rectangle. A number of the bent segments in each of the radiation units 206_R of the second microstrip radiation portion 206 is also not limited; for example, as shown in FIG. 7, each of the radiation units 206_R only has a single bent segment 214. The bent segments of the radiation units 206_R may be bent in different ways, e.g. bent in an L-shape, an arc, or any other shapes. Moreover, a number of radiation units in the second microstrip radiation portion 206 is also not limited, so long as all of the radiation units are symmetrically distributed around first microstrip radiation portion 204. For instance, as shown in FIG. 8, the second microstrip radiation portion 206 includes two radiation units 206_R. On the other hand, aforementioned disposition of the truncated corners corresponds to polarization characteristics of the antenna; namely, the truncated corners may be disposed at positions according to different applications and system requirements.

Figure 9:
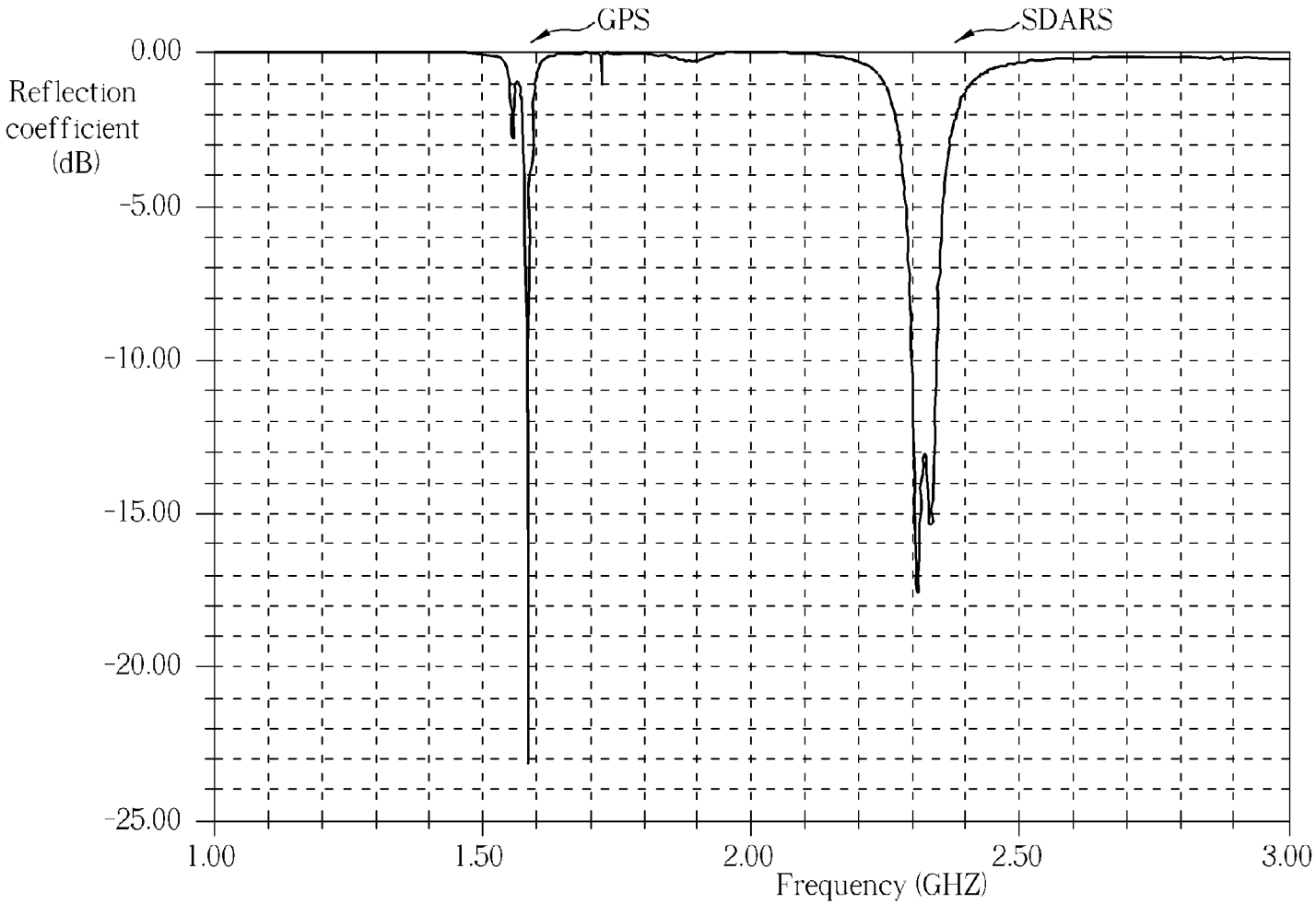
FIG. 9 is a schematic diagram of reflection coefficients of the dual-band circularly polarized antenna shown in FIG. 2.
Figure 10:
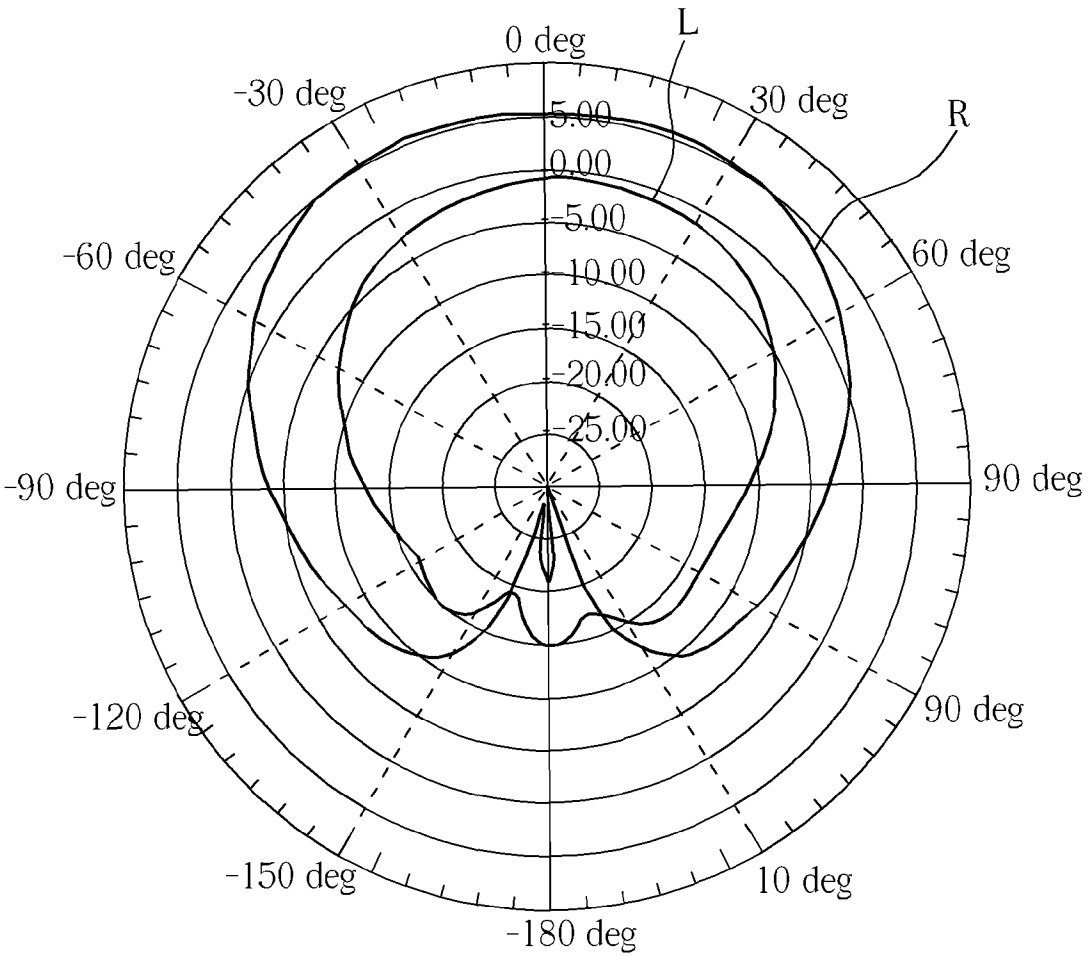
FIGS. 10 and 11 are schematic diagrams of radiation field patterns of the dual-band circularly polarized antenna shown in FIG. 2.
Figure 11:
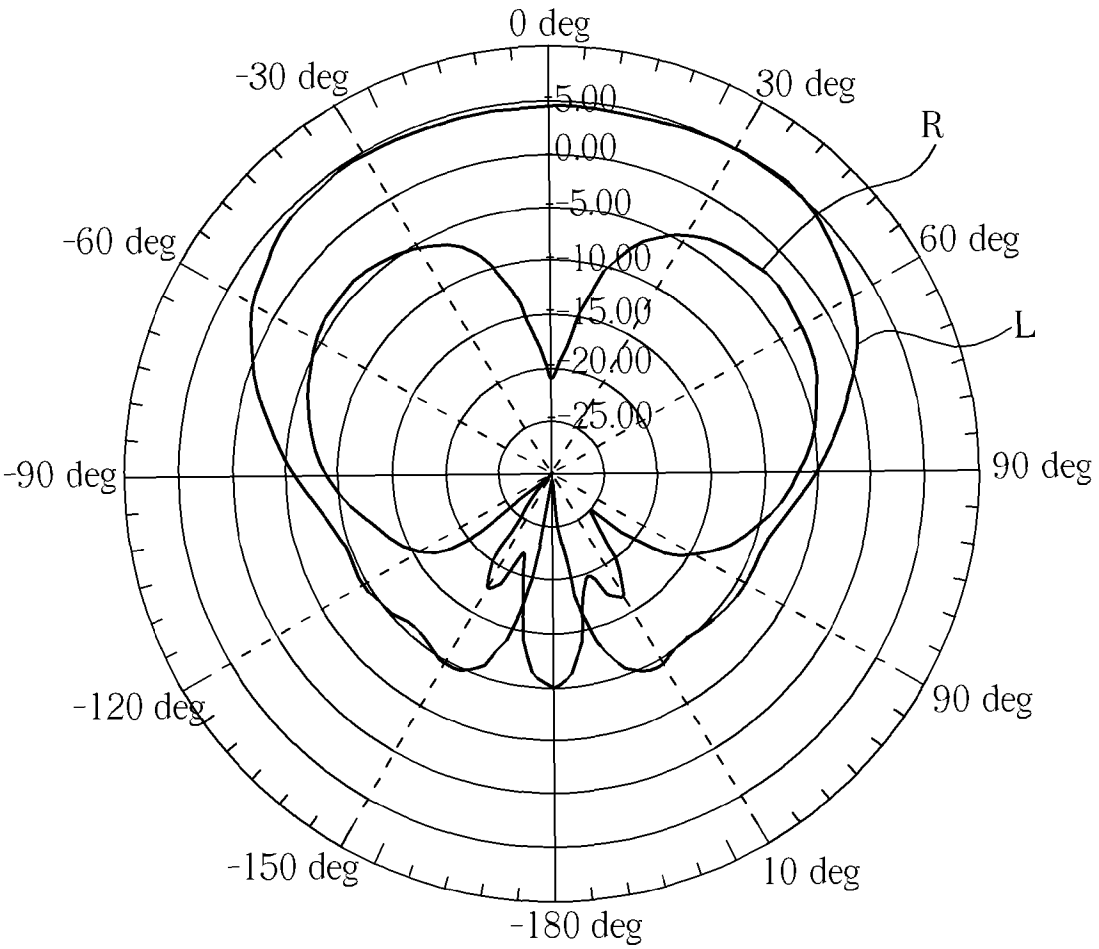

The following illustrates an application with a GPS system and an SDARS system, as an example. FIGS. 9 to 11 are schematic diagrams of simulation results of the dual-band circularly polarized antenna 20 when the first microstrip radiation portion 204 is operating in a 2.33 GHz frequency band of the SDARS signal, and the second microstrip radiation portion 206 in a 1.57 GHz frequency band of the GPS signal. FIG. 9 is a schematic diagram of reflection coefficients of the dual-band circularly polarized antenna 20 shown in FIG. 2, and displays the reflection coefficients (S11 parameter) of the dual-band circularly polarized antenna 20 when operating in the frequency bands 1.57 GHz and 2.33 GHz, respectively. FIG. 10 is a schematic diagram of a radiation field pattern of the dual-band circularly polarized antenna 20 when operating in the 1.57 GHz frequency band. FIG. 11 is a schematic diagram a radiation field pattern of the dual-band circularly polarized antenna 20 when operating in the 2.33 GHz frequency band. Line L represents a radiation field pattern for left-handed polarization, and line R represents a radiation field pattern for right-handed polarization. As shown in FIG. 10, the line R is smoother and in an outer ring, meaning that when operating in the GPS frequency band (1.57 GHz), the right-handed polarization field pattern applied to the GPS system indeed produces a higher gain as required. As can be known from FIG. 11, the line L is smoother and in the outer ring, meaning that when operating in the SDARS frequency band (2.33 GHz), the left-handed polarization field pattern applied to the SDARS system indeed produces a higher gain as required.

In summary, compared to the conventional multi-layer, stacked architecture for a multi-band microstrip antenna, the dual-band circularly polarized antenna of the invention implements a single-plane, dual-band circularly polarized architecture on a single dielectric substrate to provide an antenna with dual frequency band functionality. As such, the dual-band circularly polarized antenna of the invention not only effectively reduces dimensions of the antenna, but also greatly lowers an overall weight and production cost through reducing the required thickness and area of the dielectric substrate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dual-band circularly polarized antenna, comprising:

a ground metal plate;

a dielectric substrate, formed on the ground metal plate;

a first microstrip radiation portion, formed on the dielectric substrate, and having at least one pair of symmetric truncated corners; and a second microstrip radiation portion, formed on the dielectric substrate, comprising a plurality of radiation units, wherein each of the radiation units is coupled and extended from the first microstrip radiation portion along a first direction;

wherein the first microstrip radiation portion operates in a first frequency band, and the second microstrip radiation portion operates in a second frequency band substantially different to the first frequency band.

2. The dual-band circularly polarized antenna of claim 1, wherein the at least one pair of symmetric truncated corners of the first microstrip radiation portion are disposed on diagonal positions on a border of the first microstrip radiation portion.

3. The dual-band circularly polarized antenna of claim 1, wherein the each of the radiation units comprises at least one bent segment, and the at least one bent segment is bent along the first direction, such that the each radiation unit is extended along the first direction.

4. The dual-band circularly polarized antenna of claim 3, wherein the at least one bent segment is an L-shape.

5. The dual-band circularly polarized antenna of claim 3, wherein the at least one bent segment has a truncated corner.

6. The dual-band circularly polarized antenna of claim 1, wherein the each radiation unit at least partially encloses the first microstrip radiation portion.

7. The dual-band circularly polarized antenna of claim 1, wherein the plurality of radiation units are symmetrically distributed around the first microstrip radiation portion.

8. The dual-band circularly polarized antenna of claim 1, wherein the second microstrip radiation portion further comprises an annular radiation unit, formed on the dielectric substrate, and enclosing the plurality of radiation units.

9. The dual-band circularly polarized antenna of claim 1, wherein the annular radiation unit comprises at least one pair of symmetric truncated corners.

10. The dual-band circularly polarized antenna of claim 1, wherein the first microstrip radiation portion is a rectangle.

11. The dual-band circularly polarized antenna of claim 1, wherein the first direction is a clockwise direction or an anti-clockwise direction.

* * * * *